US006339995B1

(12) United States Patent
Beverly

(10) Patent No.: US 6,339,995 B1
(45) **Date of Patent: *Jan. 22, 2002**

(54) NEEDLE FOR A TUFTING MACHINE

(75) Inventor: Ian Beverly, Blackburn (GB)

(73) Assignee: Spencer Wright Industries, Inc., Dalton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/614,002

(22) Filed: Jul. 11, 2000

(30) Foreign Application Priority Data

Apr. 10, 2000 (GB) ..... 0008798

(51) Int. Cl.[7] ..... D05C 3/02; D05C 15/10; D05B 85/02

(52) U.S. Cl. ..... 112/80.16; 112/222

(58) Field of Search ..... 112/80.16, 80.05, 112/80.4, 80.45, 222, 224, 225, 163

(56) References Cited

U.S. PATENT DOCUMENTS 6,152,055 A * 11/2000 Beverly ..... 112/80.16

* cited by examiner

*Primary Examiner*—Peter Nerbun

(74) *Attorney, Agent, or Firm*—Alan Ruderman; Stephen J. Stark; Miller & Martin LLP

(57) ABSTRACT

A needle, which may be one of a plurality of needles in a needle module, has a rod attached to the shank adjacent the yarn guide groove or to the blade in the guide groove and extending laterally or transverse to the axis of the needle committing yarn to be directed readily into the yarn groove with a minimum angular deviation in its path. When the needle is one of several in a needle module the rod may be common to all of the needles and passed through an aligned hole in each of the needles and secured therein by bending of the rod. A yarn entrance guide is formed by each respective needle, the adjacent needle, the rod and the module body and this entrance permits ready threading of each needle.

11 Claims, 2 Drawing Sheets

NEEDLE FOR A TUFTING MACHINE

BACKGROUND OF THE INVENTION

The present invention relates to a needle for a tufting machine, namely a needle comprising a shank having an eye at one end, and a mounting portion at the opposite end with a yarn guide groove extending from the eye towards the mounting portion.

One problem with needles of this type is that the top of the yarn feed or guide groove opens into the side of the needle body so that the yarn is fed into the groove at an angle. Thus, friction between the yarn and the backing material causes an increase in yarn tension which results in problems such as stretching of the backing material, unevenness in the pile height, an increased power requirement to achieve needle penetration and an increase in loose fibers. Additionally, the yarn may be damaged because it is not lying correctly or completely in the yarn groove and may be crushed between the needle body and the backing material when the needle pierces the backing.

In an attempt to overcome these problems, a thread-feeding element has been proposed in European patent application EP-A-0882831. This thread-feeding element is essentially a guide which ensures that the yarn enters the top of the yarn feed groove and is then fed directly down the length of the needle thereby greatly reducing the contact between the yarn and backing material.

However, for various reasons, the only example which has proved practical is the double-eyed cranked needle shown in FIG. 4 of EP-A-0882831. Even with this design, there are a number of disadvantages that have limited the applications of this needle. The complex structure of the needle makes it expensive to produce. The presence of the eye towards the upper end of the needle weakens the needle. The crank configuration limits the pitch (gauge) on in-line needle bars and modules. As the double-eyed configuration makes the needle difficult to thread, single staggered needle bars and modules are not practical. Thus, the needle has been used in only a limited number of applications.

A similar arrangement proposed by the applicant, as illustrated in U.S. patent application Ser. No. 09/267,488 filed Mar. 1, 1999, U.S. Pat. No. 6,152,055 has a needle which is cranked in such a way as to provide direct access to the top of the yarn feed groove. However, this also suffers from high manufacturing costs and reduced stability at the 90° bend and may not be suitable for dual sliding needle bar machines due to threading difficulties.

SUMMARY OF THE INVENTION

Consequently, it is a primary object of the present invention to provide a needle for use in tufting machines which has an element which permits yarn to be directed readily into the yarn groove with a minimum angular deviation in its path.

It is another object of the present invention to provide a needle module mounting a plurality of needles wherein there is a common element which permits yarn to be threaded to the respective needles permitting the yarn to be directed readily into the respective yarn groove with a minimum angular deviation in each respective path.

According to the present invention, a needle of the kind described is characterized by a rod attached at the shank above the blade or in the top of the groove at the top of the blade opposite the end of the needle having the point and projecting laterally from the needle.

This simple idea has a number of very important advantages. It is inexpensive to produce as it requires only that a rod be attached to an existing type of needle. The invention can be applied to any existing arrangement of needles. As it does not require a crank type configuration, it does not limit the pitch of the needles. The presence of the rod does not weaken the needle as does the presence of a second eye.

The rod may simply be welded to the needle in or adjacent the groove in the needle. However, the current preference is for a through-hole to be provided in the needle, through which hole the rod extends. In this case, the rod is preferably retained in the through-hole by being bent at at least one location.

The needle may be individually mounted directly to a needle bar, or to a module which is fixed to the needle bar. In either case, the invention may extend to a needle assembly provided with a plurality of needles in which the rod is common to all of the needles. In this case, a yarn entrance guide will be formed by the needle, the adjacent needle, the rod, and the component to which the needles are mounted. This is a large area and provides for simple threading of the needle.

The rod is preferably chamfered at one end in order to facilitate insertion through the through-holes and to aid the insertion and extraction of a module from its backing bar without disturbing neighboring modules.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

In most respects, the structure of the needles and a tufting machine in which the needles are mounted is entirely conventional, and further details need not be provided here.

Figure 3:
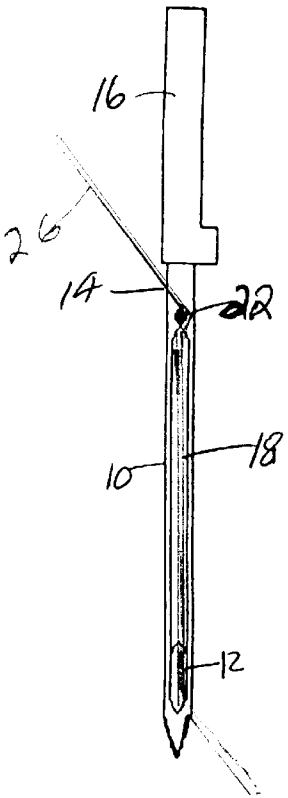
FIG. 3 is a side elevational view of the modules shown in FIG. 2.
Figure 2:
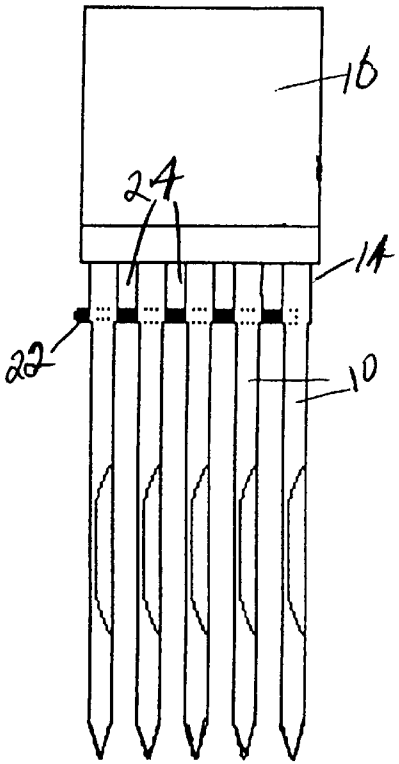
FIG. 2 is an elevational view of a needle module incorporating five needles as shown in FIG. 1.
Figure 1:
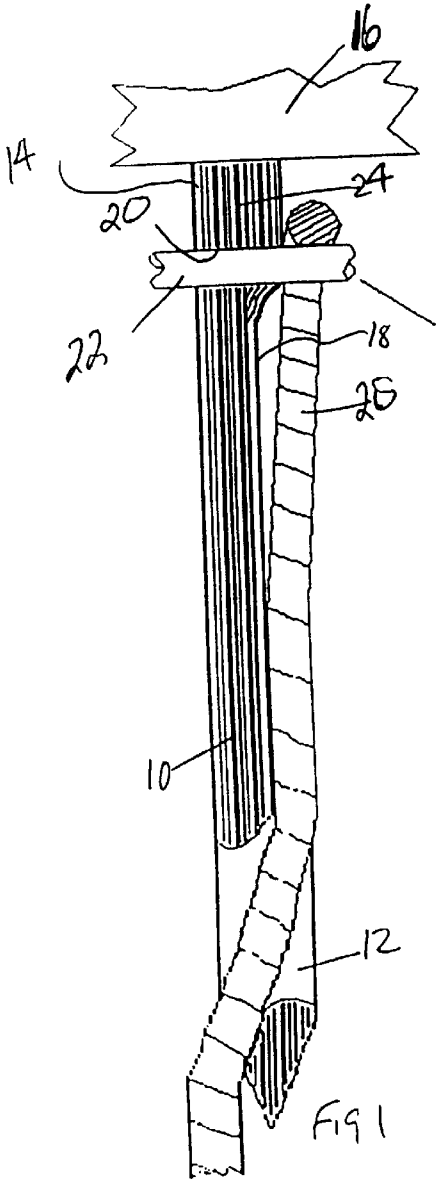
FIG. 1 is a cross-sectional view taken through a single needle, incorporating the principles of the present invention and showing yarn threaded through the needle.

The needle 10 has an eye 12 at its lowermost end and has a shank 14 including a mounting portion at its uppermost end which may be mounted in a needle module 16, the module carrying a plurality of such needles. A yarn feed groove 18 extends from the eye 12 up to the blade of the needle most of the way towards the shank 14 and the module 16. As illustrated in the embodiment of FIGS. 1–3, the shank 14 of the needle above the yarn feed groove 18 may be provided with a through-hole 20 which may be formed using EDM or other relevant precise hole boring equipment. The hole preferably has a diameter of 1 mm and maybe drilled either prior to the needle being mounted in the module 16, or all of the needles 10 may be mounted in the module 16 before all of the through-holes 20 for each needle in the module 16 are drilled together.

Once the holes are drilled, a hardened round steel pin or rod 22 is inserted through the holes 20 and may be locked in place by slightly bending the pin at one or more locations. A yarn entrance guide 24 for each needle is thus created in the area bound by the module 16, the rod 22, the part of the needle 10 above the rod 22, preferably the shank 14, and the facing part of the adjacent needle. This is a relatively large area through which it is easy to thread the yarn 26. The yarn 26 extends down the yarn feed groove 18 and through the eye 12. The tension applied to the yarn will ensure that it is always maintained in close proximity with the rod 22, and the yarn feed groove 18. Since the rod positions the yarn closely to the groove 18 as compared to the situation where yarn is fed directly to the eye 12 and thus at a substantially steeper angle to the axis of the needle, the problems of prior art needles are as heretofore noted are substantially alleviated.

As shown in FIG. 2, the rod protrudes from one side, here the lefthand side of the module. This will engage with an adjacent needle in the adjacent module to form a guide for that needle. At one end of a row of needles, a dummy needle can be provided so as to provide a yarn entrance guide for the endmost needle.

Figure 4:
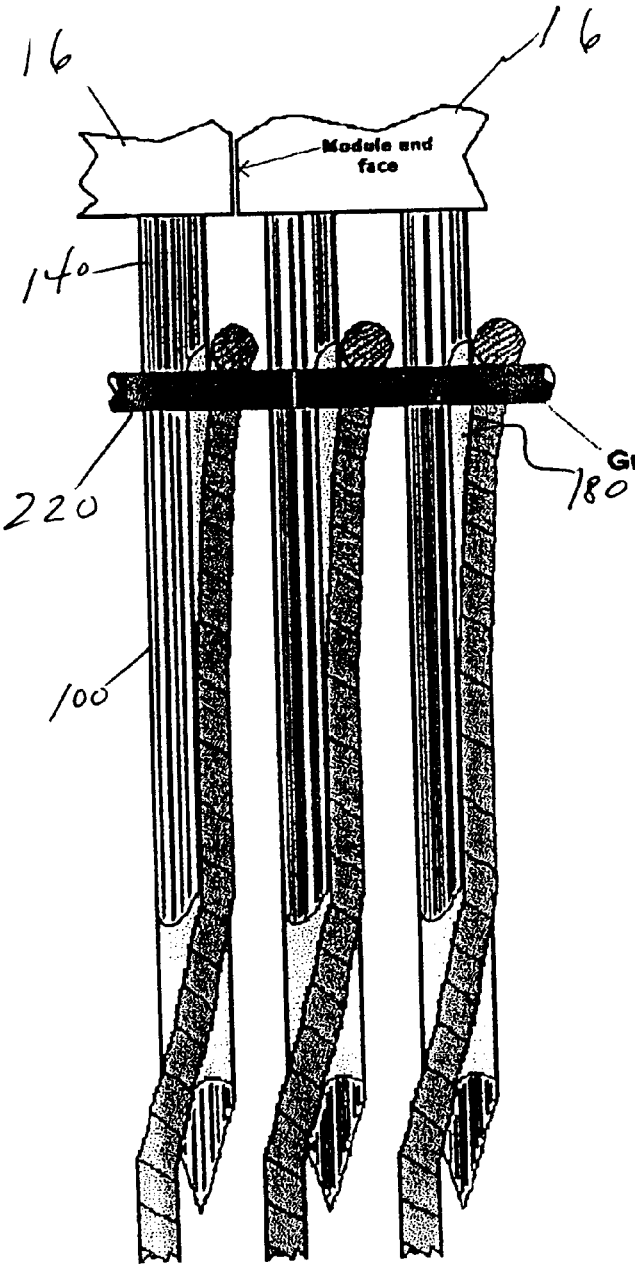
FIG. 4 is a view similar to FIG. 1 illustrating the needles at the interface of two adjacent modules and with the rods in the groove.
Figure 5:
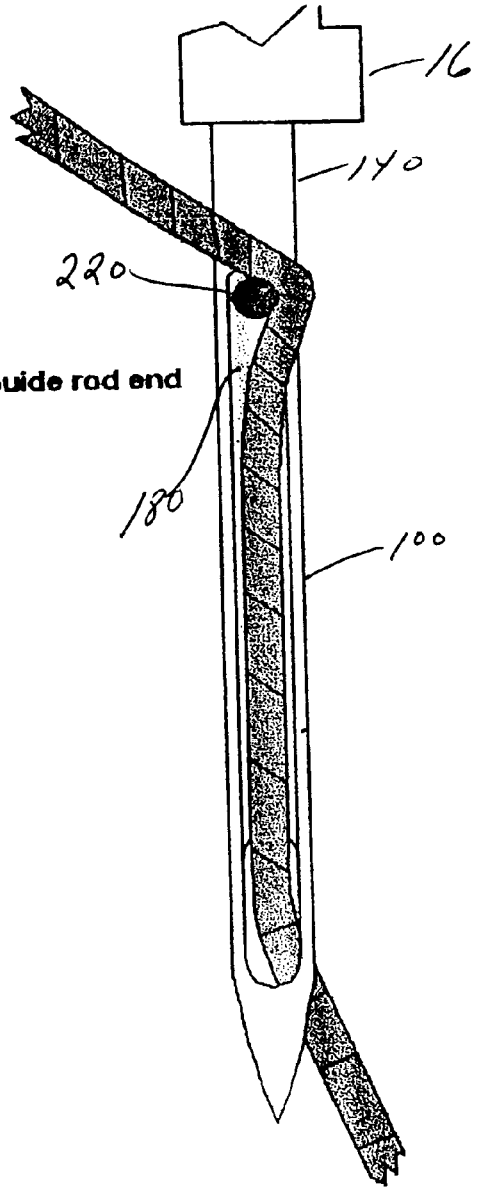
FIG. 5 is a view similar to FIG. 3, but with the rods located as in FIG. 4.

In the embodiment illustrated in FIGS. 4 and 5, the rod 220 may be positioned in through a hole which is within the groove 180 of the needle 100 so that the rod is within the blade of the needle below the shank 140. In all other respects the needles of FIGS. 4 and 5 are identical to that illustrated in FIGS. 1–3.

The invention may be applied to a single individual needle which may be mounted in a needle bar with other similar needles, or as herein disclosed, applied to the needles in a module. In the former case, each needle may have a rod 6 which extends toward an adjacent needle rather than a common rod as in the preferred form which used in a needle module.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A needle for a tufting machine comprising an elongated body member including a shank having a mounting portion, a blade extending from the shank to a point portion terminating in a tip, an eye adjacent said point portion extending transversely through said blade, and a yarn feed groove extending from the eye towards the shank, wherein the improvement comprises a rod attached to the shank and projecting transversely from the needle.

2. A needle as recited in claim 1, wherein a through-hole is provided in the needle, and said rod extends through said hole.

3. A needle as recited in claim 2, wherein said rod is bent in at least one location to retain it in place.

4. A needle for a tufting machine comprising an elongated body member including a shank having a mounting portion, a blade extending from the shank to a point portion terminating in a tip, an eye adjacent said point portion extending transversely through said blade, and a yarn feed groove extending from the eye towards the shank, wherein the improvement comprises a rod attached to the blade in the groove and projecting transversely from the needle.

5. A needle as recited in claim 4, wherein a through-hole is provided in the needle, and said rod extends through said hole.

6. A needle as recited in claim 5, wherein said rod is bent in at least one location to retain it in place.

7. A needle module comprising a body member carrying a plurality of needles extending therefrom in side by side spaced apart relationship, each of said needles comprising an elongated body including a shank having a mounting portion, a blade extending from said shank to a point portion terminating in a tip, an eye adjacent said point portion extending transversely through said blade, and a yarn feed groove extending from the eye towards the shank, wherein the improvement comprises a rod attached to one of the shank and blade of each needle and projecting transversely therefrom.

8. A module as recited in claim 7, wherein said rod is in said groove adjacent said shank.

9. A needle module as recited in claim 8, in which said rod is common to all the needles.

10. A needle as recited in claim 8, wherein a through-hole is provided in each needle, and said rod extends through said holes.

11. A module as recited in claim 10, wherein said rod is bent in at least one location to retain it in said holes.

* * * * *